US007216905B1

(12) United States Patent
Armes, Jr.

(10) Patent No.: US 7,216,905 B1
(45) Date of Patent: May 15, 2007

(54) REFUSE REMOVAL SYSTEM AND METHOD FOR REMOVING REFUSE

(76) Inventor: Andrew Armes, Jr., 1029 Lucabaugh Mill Rd., Westminster, MD (US) 21157

( * ) Notice: Subject to any disclaimer, the term of this patent is extended or adjusted under 35 U.S.C. 154(b) by 0 days.

(21) Appl. No.: 11/403,861

(22) Filed: Apr. 14, 2006

Related U.S. Application Data

(60) Provisional application No. 60/741,906, filed on Dec. 5, 2005.

(51) Int. Cl.
*A01K 29/00* (2006.01)
*E01H 1/12* (2006.01)

(52) U.S. Cl. ..... 294/1.3

(58) Field of Classification Search ..... 294/1.3, 294/1.4, 55, 118; 15/257.1, 257.6, 104.8, 15/257; 119/161
See application file for complete search history.

(56) References Cited

U.S. PATENT DOCUMENTS

| | | | | |
|---|---|---|---|---|
| 3,676,887 | A | 7/1972 | Klein | |
| 3,813,121 | A * | 5/1974 | Marvin | 294/1.3 |
| 3,841,684 | A * | 10/1974 | Fleishman | 294/1.3 |
| 3,850,467 | A | 11/1974 | Johnson | |
| 3,978,540 | A | 9/1976 | Peck et al. | |
| 4,132,442 | A * | 1/1979 | Larsson | 294/1.3 |
| 4,215,886 | A * | 8/1980 | Naderi et al. | 294/1.3 |
| 4,215,887 | A | 8/1980 | Boots | |
| 4,273,370 | A | 6/1981 | Kjaer | |
| 4,747,633 | A | 5/1988 | Stacy | |
| 4,875,729 | A | 10/1989 | Peck | |
| 5,186,506 | A | 2/1993 | Gale | |
| 5,222,777 | A | 6/1993 | Clonch | |
| 5,358,295 | A | 10/1994 | Campbell | |
| 5,370,431 | A | 12/1994 | Henninger et al. | |
| 5,385,376 | A | 1/1995 | Malaspina et al. | |
| 5,564,763 | A * | 10/1996 | Mercurio | 294/1.3 |
| 5,836,629 | A * | 11/1998 | Hobart | 294/1.3 |
| 6,059,332 | A | 5/2000 | Beascoechea Inchaurraga | |
| 6,059,333 | A | 5/2000 | De Toma | |
| 6,832,796 | B1 | 12/2004 | Minassians | |

* cited by examiner

*Primary Examiner*—Dean J. Kramer
(74) *Attorney, Agent, or Firm*—Rosenberg, Klein & Lee

(57) ABSTRACT

A refuse removal system for picking up waste material in an optimally sanitary manner including a claw mechanism including a first set of arcuately formed finger members and a second set of arcuately formed finger members that are displaced each from the other in a longitudinal direction. A flexible bag having an open section and a closed section is fixedly attached to the claw mechanism. A pair of actuating members provides actuation of the arcuately formed finger members between an open and closed position. Prior to operation of the refuse removal system, the first and second sets of arcuately formed finger members are located external to the bag while the actuating members are internal to the bag in a manner in which the claw mechanism passes through the bag wall.

22 Claims, 6 Drawing Sheets

REFUSE REMOVAL SYSTEM AND METHOD FOR REMOVING REFUSE

REFERENCE TO RELATED APPLICATIONS

This Patent Application is based upon Provisional Application Ser. No. 60/741,906 filed 5 Dec. 2005.

BACKGROUND OF THE INVENTION

1. Scope of the Invention

This invention relates generally to devices for the pickup and removal of waste material such as refuse, and more particularly to an improved device for the optimally sanitary disposal of dog droppings and the like.

2. Prior Art

Due to the unsightly and unsanitary nature of dog droppings along sidewalks, roads and grassy areas, many communities have enacted regulations and laws requiring that pet owners not only leash dogs during walks, but also require the pickup and removal of any dog droppings deposited during the walk. In some cases, severe penalties are provided for enforcement of violations.

A number of devices have been both patented and marketed which facilitate both pickup and removal of dog droppings and the like. A simple device for accomplishing the same is the utilization of a small plastic disposable bag or pouch within which the dog's owner places his or her hand for protective manual pickup of the droppings. Subsequently the flexible plastic bag is reversed or turned inside out and sealed or knotted to close the bag opening. A significant psychological drawback is encountered utilizing this known methodology, that drawback being associated with protected indirect contact with soft, malleable droppings.

Various sizes and shapes of "pooper scoopers" have also been marketed. When used directly, the inner and outer surfaces of such devices become soiled and must be rinsed or washed after each use. Accordingly, pet-owners (and others) are often confronted with pet waste having available only an awkward scoop or shovel or, worse, a simple plastic bag for use together with whatever other "tools" may be afforded by their immediate environment. Other solutions known in the art such as disposable surgical gloves, paper tissues, sandwich bags and the like do little to reduce the well-known unpleasantness of the pet sanitation task. None of these alternatives provides for optimal sanitary gathering and capturing of pet waste.

The use of mechanical type waste removal and capturing systems often relies on the cleaning of the system subsequent to which is time consuming and may not be sanitary. Thus, there is a need for a waste removal and capturing system which is disposable as a unit.

There is further a need for a waste removal and capturing system which is easily manufactured, low cost in manufacture and is sufficiently cost optimized in order that the consumer may discard the system after one time use.

There is a further need in the art for a device that is capable of removing waste, such as, soft animal excrement from relatively tall grassy areas. Conventional "pooper-scoopers" are not able to properly remove soft excrement from such areas. For example, the use of a plastic bag wrapped around a user's arm still requires a user to comb through tall grassy areas (while indirectly touching the soft waste excrement) which still does not result in proper removal of the soft droppings. Thus, there is a need for a waste removal encapturing system which is able to properly remove waste, such as, soft animal droppings from grassy areas.

There is a still further need for a waste removal system which permits the user to substantially encapsulate the waste material and cradle the waste material within a substantially closed region where the waste material may be gently removed.

There is a further need in the art for a simple device that solves these problems of awkwardness, inconvenience, and distastefulness associated with gathering and disposing of pet waste. These unresolved problems and deficiencies are clearly felt in the art and are solved by our invention in the manner described below.

SUMMARY OF THE INVENTION

This invention is directed to a refuse removal system for picking up waste material and the like in an optimally sanitary manner including a claw mechanism having a first and second set of arcuately formed finger members. Each of the first and second set of arcuately formed finger members are displaced each from the other in a longitudinal direction. A flexible bag member having an open section and a closed section is fixedly attached to the claw mechanism substantially in the area of a hinge member. The hinge member, which may be a spring loaded hinge member, joins together the first and second set of arcuately formed finger members. A pair of actuating members, which may be formed in one piece formation with each respective set of arcuately formed finger members, provides actuation of the arcuately formed finger members between an open and closed position. Prior to operation of the refuse removal system, the first and second sets of arcuately formed finger members are located external to the bag while the actuating members are internal to the bag such that the claw mechanism passes through the bag member wall.

It is therefore an object of this invention to provide a refuse removal system which is economical to manufacture and convenient to use.

It is another object of this invention to provide a refuse removal system which is disposable.

It is still another object of this invention to provide a refuse removal system that can properly remove refuse, such as, soft animal droppings from grassy areas.

A still further object of this invention is to provide a waste removal system which permits the user to gently cradle the waste material within a claw type mechanism for removal of the waste material in an efficient manner.

It is still another object of this invention to provide an optimally sanitary method for removing refuse, for example, animal droppings.

It is still another object of this invention to provide a device for picking up and removing refuse and the like which avoids any direct or indirect hand contact with the droppings and means for enclosing and disposing of the refuse.

A still further object of this invention is to provide a device for picking up and removing refuse and the like having a first set of arcuately formed finger members and a second set of arcuately formed finger members for more effective engagement with the dog droppings when embedded in grass and dirt.

In accordance with these and other objects which will become apparent hereinafter, the instant invention will now be described with reference to the accompanied drawings.

DESCRIPTION OF THE PREFERRED EMBODIMENTS

Figure 1:
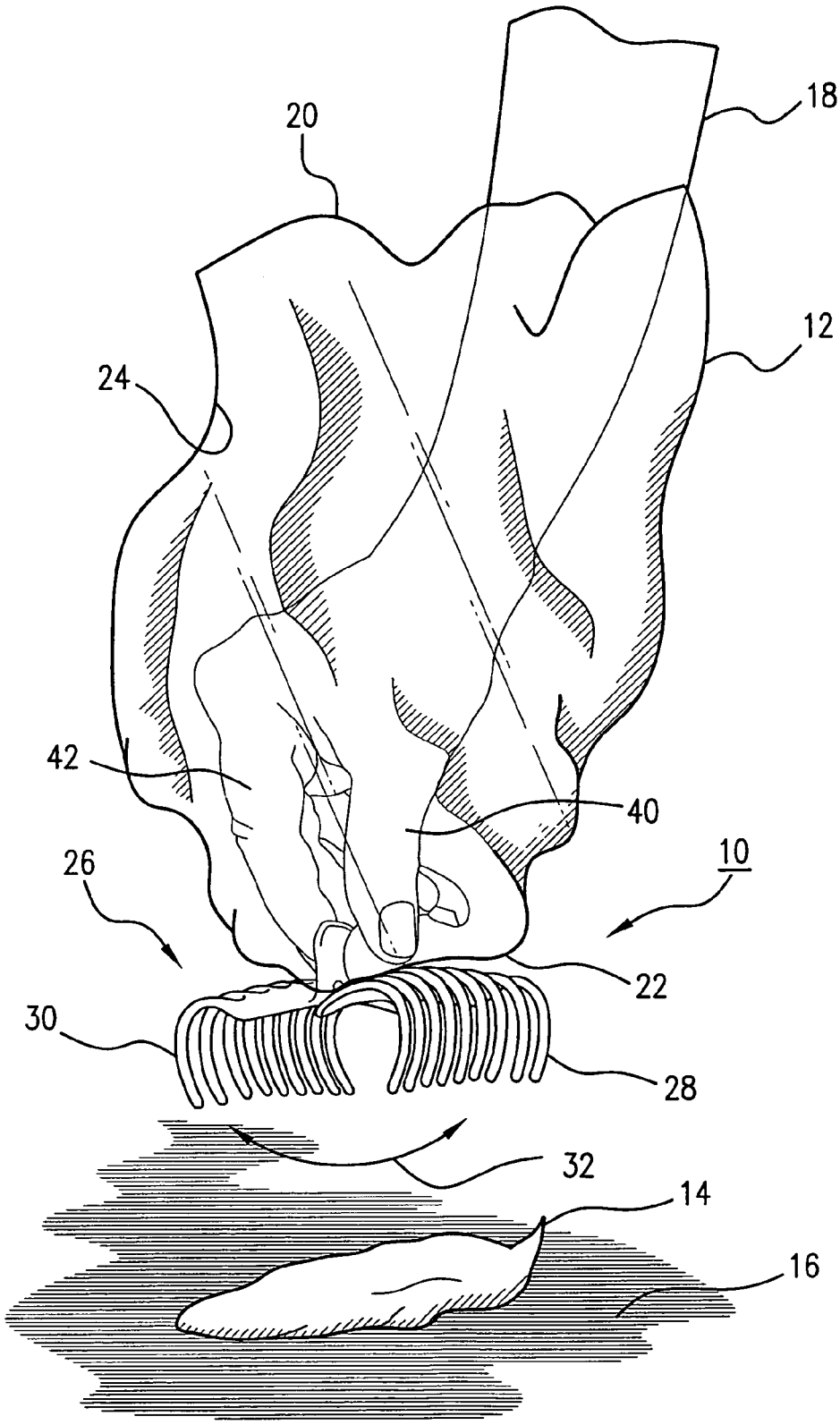
FIG. 1 is a perspective view of the refuse removal system being held in an open position.

Referring now to FIGS. 1–5 there is shown refuse removal system 10 for disposal of refuse 14 in an optimally sanitary manner. Refuse 14 may be excrement or other waste material disposed on a base surface 16.

Refuse system 10 includes bag 12 having an open section 20 and a closed end section 22. The user inserts his/her arm via the open section 20 of bag 12 thereby isolating the user's arm from refuse 14 to be removed from base surface 16. Bag 12 may be formed of any composition which is impervious to passage of refuse 14 through the bag wall 24. Bag 12 may be formed of a closed cell plastic composition and may preferably be transparent. Bag 12 is flexible in nature and may be manipulated by the user.

Refuse system 10 further includes claw mechanism 26 which as will be seen in following paragraphs passes through the closed end of bag wall 24. Claw mechanism 26 includes a first set of arcuately formed finger members 28 and a second set of arcuately formed finger members 30 which are displaceable each with respect to the other. Each of first and second sets of finger members 28 and 30 are displaced each from the other in longitudinal direction 32 as is seen in FIG. 1 and defined by directional arrow 32.

As can be seen in FIG. 1, the individual finger members of the first and second sets of arcuately formed finger members 28, 30 are spaced apart sufficiently thereby forming an open cage type structure. This type of arrangement allows for the first and second sets of finger members 28, 30 to have a raking effect which allows for removal of refuse 14, such as soft animal droppings, from all types of grassy areas.

Figure 2:
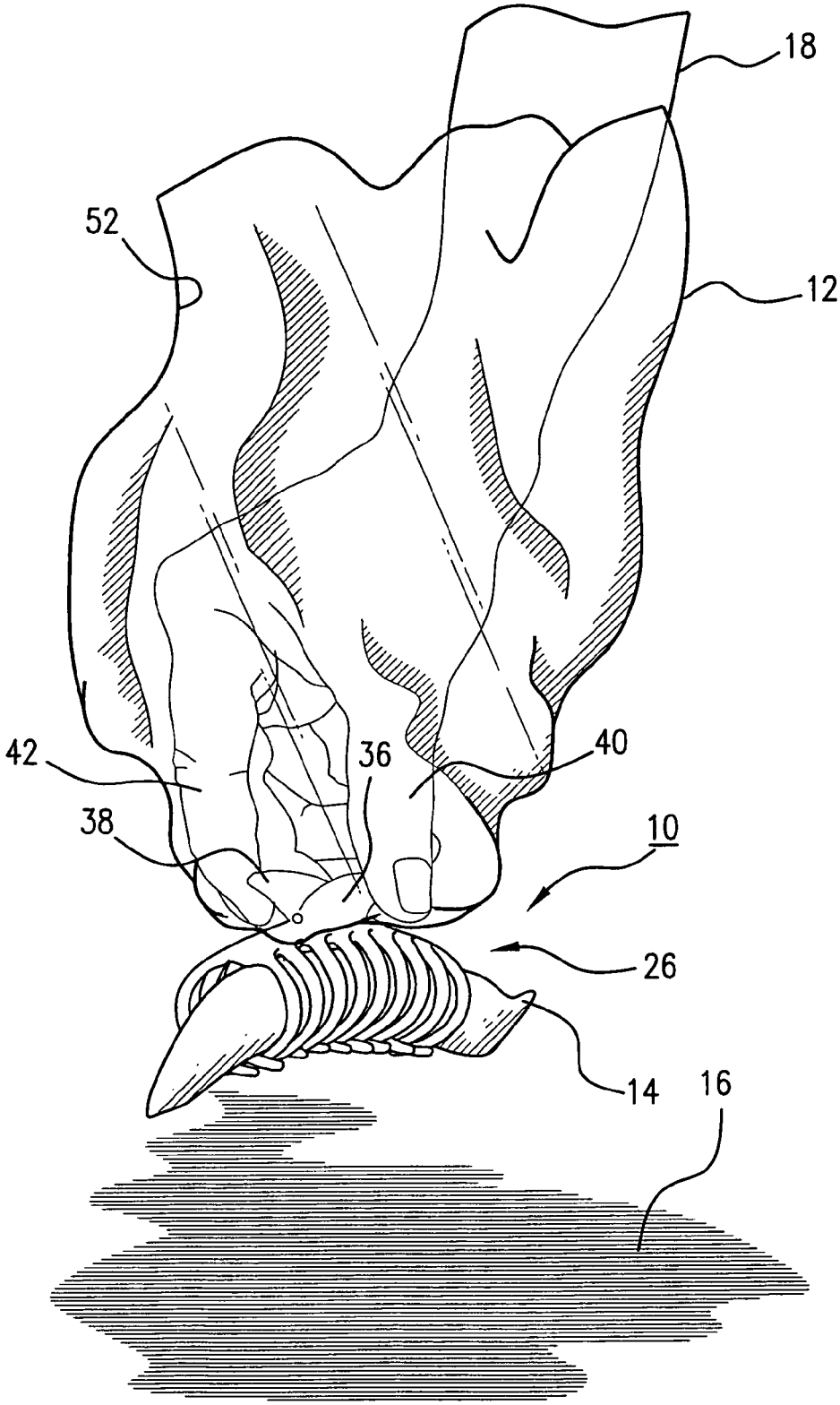
FIG. 2 is a perspective view of the refuse removal system being held in a closed position with refuse contained therein.

As can be seen in FIG. 1 first and second sets of finger members 28 and 30 are initially disposed in an open condition and further as is seen in FIG. 2 the first and second sets of finger members 28 and 30 are in a closed position subsequent to grasping of refuse 14 from base surface 16.

Figure 5:
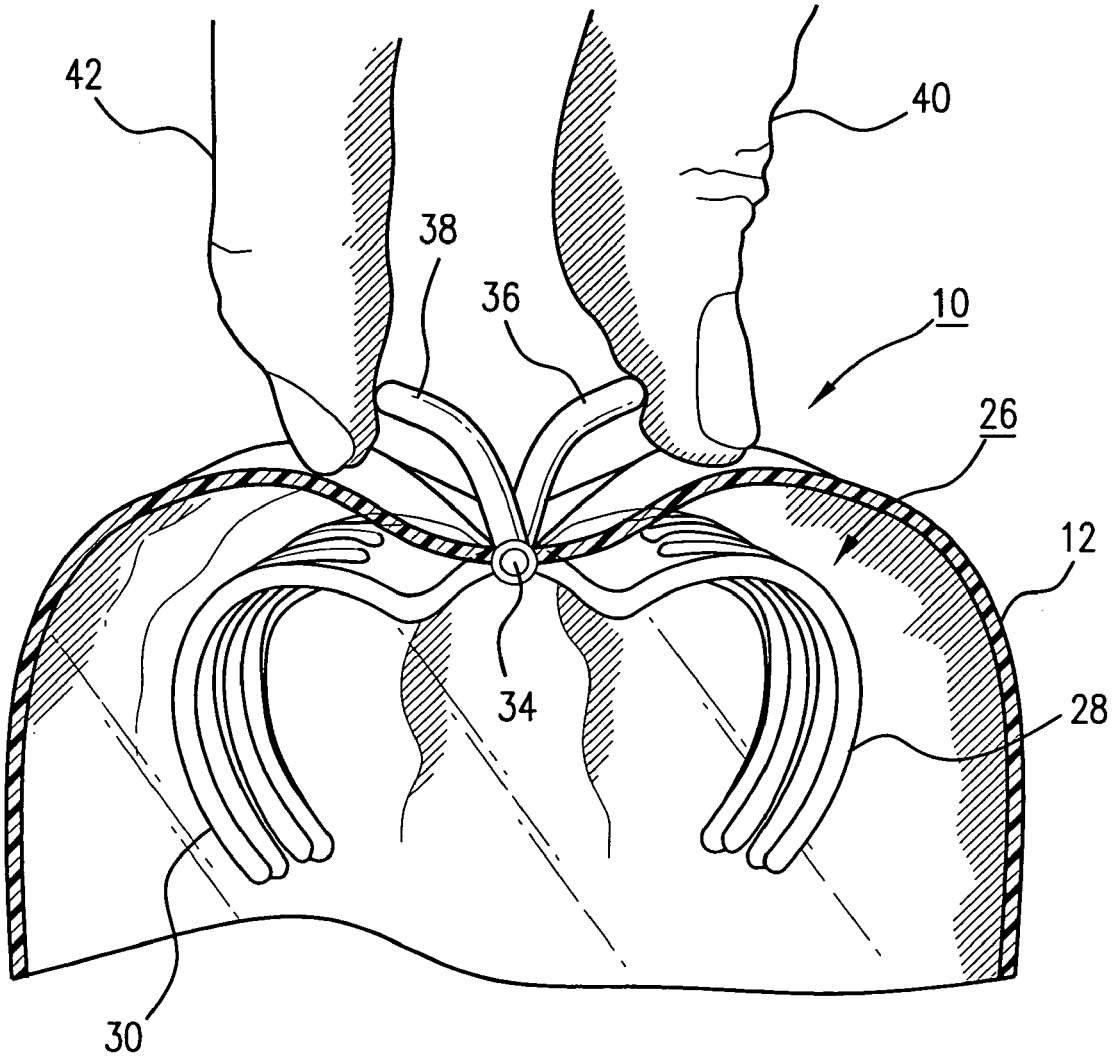
FIG. 5 is a cross-sectional view partially of the cut-away refuse removal system in an open position with the bag member inverted.

As is seen in FIG. 5 first and second sets of finger members 28 and 30 (shown in the open position prior to grasping of refuse 14) are joined by hinge member 34 which may be a spring loaded hinge member well known in the art. Hinge member 34 substantially joins first and second sets of finger members 28 and 30 to allow displacement of first set of finger members 28 from second set of finger members 30 in a reversible manner.

As can be seen in FIGS. 1–4, first sets of finger members 28 and second sets of finger members 30 are longitudinally displaced each with respect to the other in a manner to allow the interfacing, insertion and interlacing of first set of finger members 28 between respective finger members of second set of finger members 30. In this manner refuse 14 may be substantially encompassed by the interlaced sets of finger members 28 and 30 as is more clearly seen in FIGS. 2 and 3. Further, such interlacing of finger members 28, 30 allows for easier removal of refuse 14 from grassy areas.

Figure 3:
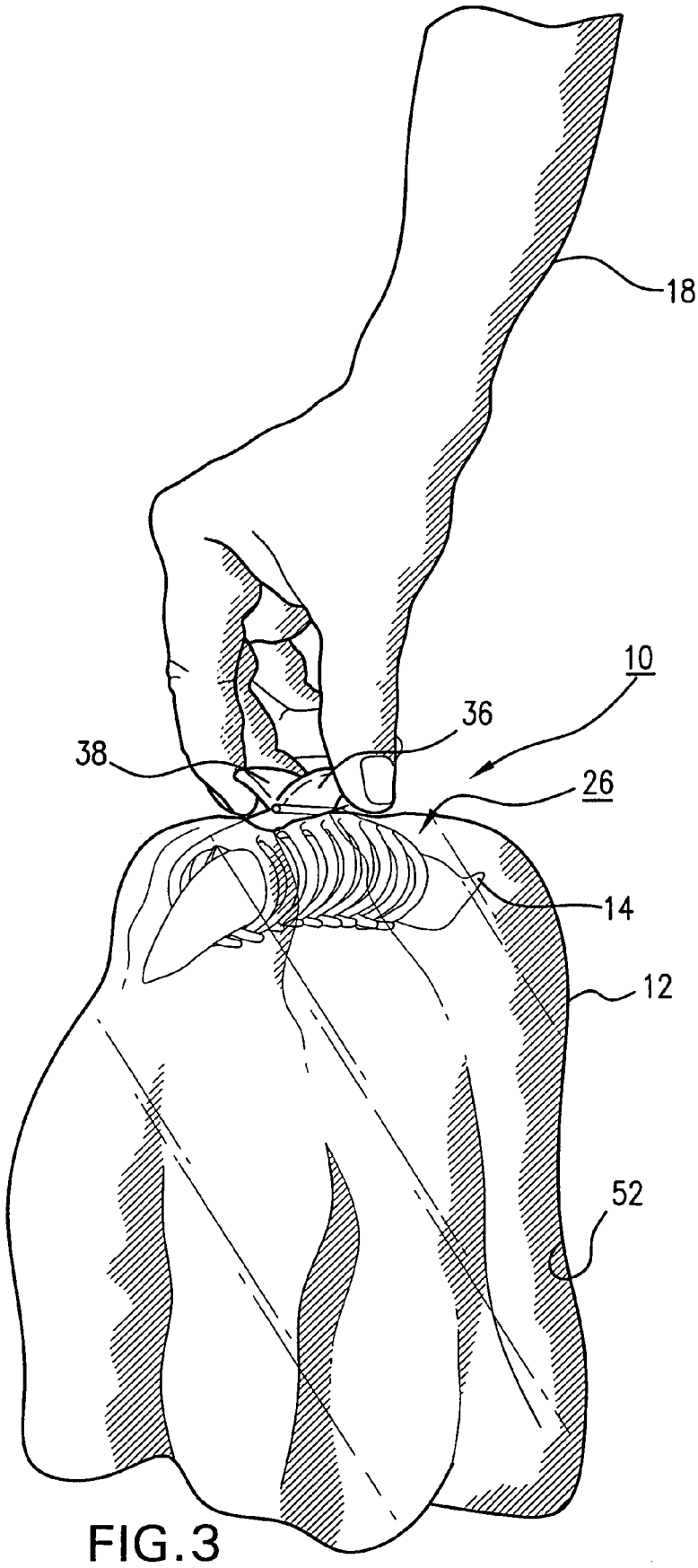
FIG. 3 is a perspective view of the refuse removal system being held in a closed position with refuse contained therein with the bag member inverted and containing the device and the refuse.
Figure 4:
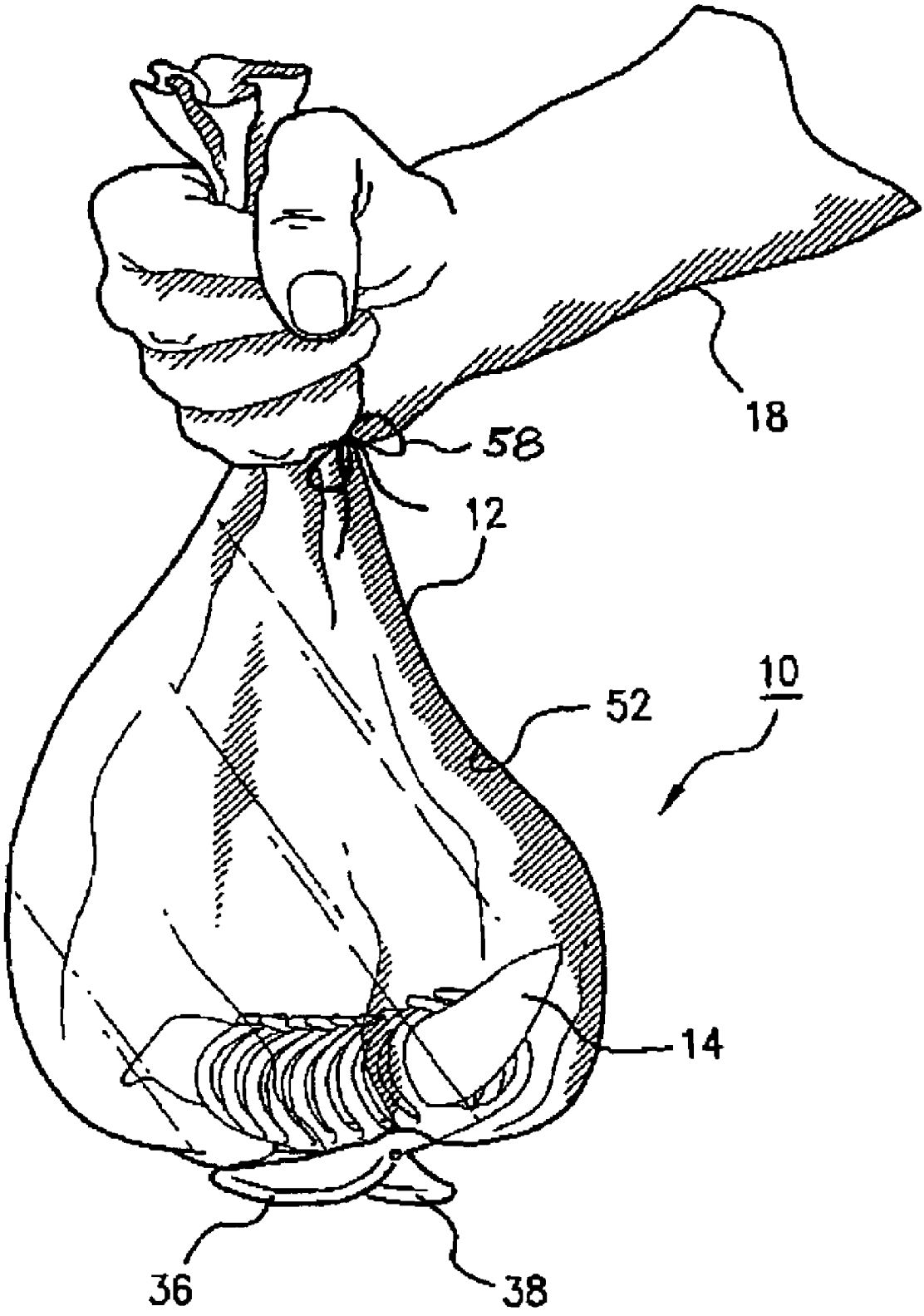
FIG. 4 is a perspective view of the refuse removal system being held in a closed position with refuse contained therein with the bag member grasped from the open end.

As is seen in FIGS. 2–3, the first and second sets of arcuately formed finger members 28, 30 when in the closed position, form a cradling effect whereby the claw mechanism 26 forms a grasping structure to cradle refuse 14. Specifically, the first and second sets of finger members 28, 30 cooperate with each other to provide the cradling effect of the claw mechanism 26. In this manner, the present invention is able to grasp and cradle all types of refuse 14 from any type of base surface 16 (grass, concrete, etc.).

Claw mechanism 26 further includes a pair of actuating members 36 and 38, more clearly seen in FIG. 5, for displacing first and second sets of finger members 28 and 30 in a manner from a closed position to an open position as previously described. Actuating members 36 and 38 are adapted to be grasped between the fingers 40 and 42 of the user's arm 18 to provide actuation of first and second sets of finger members 28 and 30. As can be more clearly seen in FIG. 5, actuating member 38 may be formed in one piece formation with second set of finger members 30. In similar fashion, actuating member 36 may be formed in one piece formation with first set of finger members 28. Such one piece formation provides actuation of sets of finger members 28 and 30 between an open and a closed position.

Figure 6:
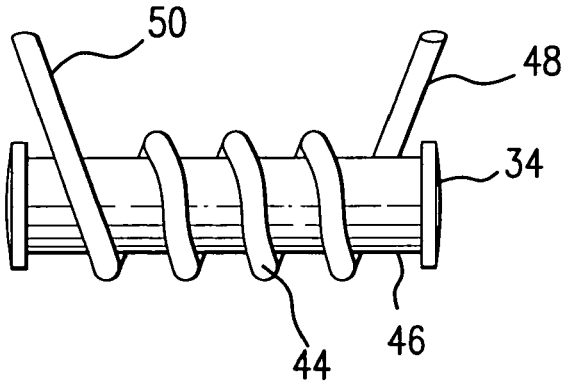
FIG. 6 is an exploded view of the hinge member.

As is seen in FIG. 6, hinge member 34 may be a standard spring biased hinge member which includes a torsion spring 44 wound around a central bearing shaft 46. The hinge member further includes end extension sections 48 and 50 to bear against respective actuating members 36 and 38. In this manner, a spring biasing force is provided to actuating members 36 and 38 to bias such in an open position or a closed position.

First and second sets of finger members 28 and 30 as well as actuating members 36 and 38 may be formed of a metal composition, plastic composition or some like composition not important to the inventive concept as herein described with the exception that such composition be able to withstand the forces of grasping and removal of refuse 14 from base surface 16.

Prior to operation and removal of refuse 14 from base surface 16, first and second sets of finger members 28 and 30 are positionally located external to bag 12. Actuating members 36 and 38 forming grasping elements are internal to bag 12. Claw mechanism 26 thus passes through bag wall 24 and is fixedly attached thereto substantially in the area of hinge member 34. Claw mechanism 26 may be secured to bag wall 24 at the closed end thereof by heat sealing, fixed attachment by threading, or some like technique not important to the inventive concept of the invention. Thus, as is seen in FIG. 5, actuating members 36 and 38 are on opposing sides of bag wall 24 when taken with respect to first and second sets of finger members 28 and 30 prior to removal of refuse 14 from base surface 16.

Figure 7:
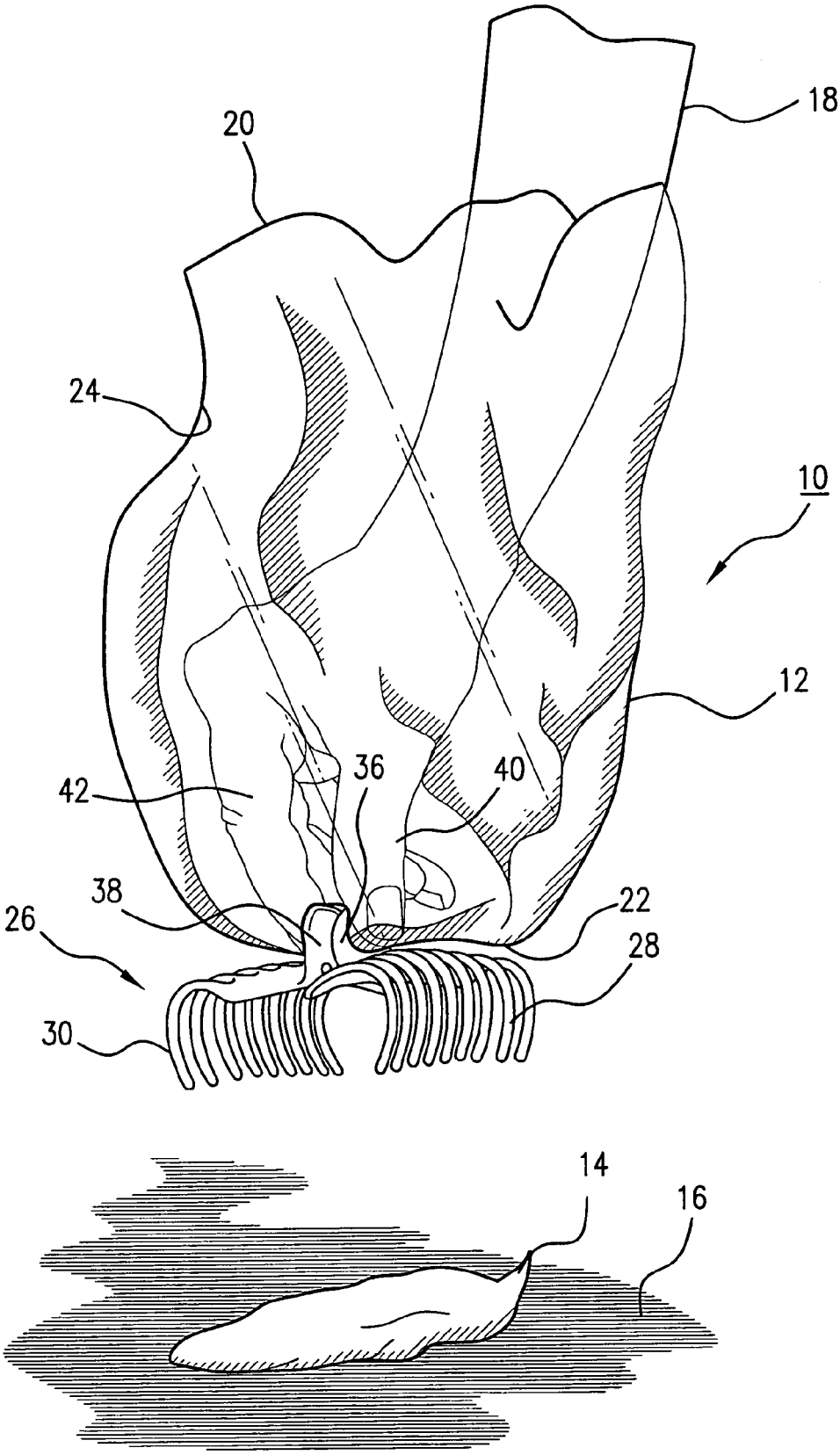
FIG. 7 is a perspective view of the refuse removal system according to an alternative embodiment of the present invention.

In the alternative embodiment, as shown in FIG. 7, the bag 12 may be sealed/attached to the claw mechanism 26 in a manner where the claw mechanism 26 is located completely external the bag 12. Specifically, the bag wall 24 at the closed end section 22 may be attached to the claw mechanism 26 at a portion or multiple portions of the actuating members 36, 38. In this manner of attachment, no part of the claw mechanism 26 passes through the closed end section 22 of the bag wall 24. Furthermore, no portion of the claw mechanism 26 passes through any portion of the bag wall 24 of the bag 12. Therefore, the entire claw mechanism 26 will be on one side of the bag wall 24 prior to removal of refuse 14 from the base surface 16. After removal of refuse 14 from base surface 16, the entire claw mechanism 26 with the refuse 14 contained therein will be contained within the bag 12.

As detailed above, the bag 12 will be flexible in nature. In certain alternate embodiments such as that shown in FIG. 7, the bag 12 will be suitably attached to the claw mechanism 26 thereby giving the bag 12 enough slack so that a user may properly grip and operate the claw mechanism 26 without ripping/tearing bag 12. In this manner, the bag 12 may be formed of an elastic material or any other suitable material that enhances the flexibility of the bag 12. For example, the bag 12 may be attached to the claw mechanism 26 in a pleated manner or any other suitable manner thereby providing enough slack so that a user may more quickly and easily grip the claw mechanism 26.

A string member 58 is secured to the bag 12 at the upper end of the bag 12. The string member 58 is used to tie the bag 12 closed after waste material or refuse 14 is contained within bag 12.

In overall concept, refuse system 10 is established for removal of refuse 14 from a base surface 16 and provides a method for removal in an optimally sanitary manner.

The method of removal of refuse 14 for final disposal includes the step of providing a bag member 12 having an internal volume 52 defining a bag interior and further defining an inner surface and outer surface of bag wall 24. Claw mechanism 26 is provided to grasp waste material or refuse 14 and extends through the wall 24 of bag member 12 and is secured thereto by heat sealing, threading or some like technique.

Initially, arm 18 of the user is inserted within bag interior 52 and the user's fingers 40 and 42 grasp actuating members 36 and 38 within bag 12.

First and second sets of finger members 28 and 30 are opened as is seen in FIG. 1 to a position overlying refuse 14. Refuse 14 is then at least partially encompassed by the opened first and second sets of finger members 28 and 30 for removal from base surface 16. The opening of first and second sets of finger members 28 and 30 is shown in FIG. 1 and the closed position of sets of finger members 28 and 30 are shown in FIG. 2 subsequent to the removal of refuse 14 from base surface 16.

Subsequently, bag 12 is folded over the captured refuse 14 as is shown in FIG. 3. As is further shown in FIG. 4 bag member 12 containing refuse 14 may be closed and tied by string member 58. Finally, refuse 14 is removed to a waste containment container for disposal of refuse or waste material 14.

Although this invention has been described in connection with specific forms and embodiments thereof, it will be appreciated that various modifications other than those discussed above may be resorted to without departing from the spirit or scope of the invention. For example, functionally equivalent elements may be substituted for those specifically shown and described, and in the process method steps described, particular steps may be reversed or interposed, all without departing from the spirit or scope of the invention as defined in the appended claims.

What is claimed is:

1. A refuse removal system for picking up waste material and the like in an optimally sanitary manner comprising:

a claw mechanism having a first set of arcuately formed finger members and a second set of arcuately formed finger members pivotally mounted each to the other and longitudinally displaceable each from the other, said first and second set of arcuately formed finger members being displaceable from a first position to a second position whereby said first and second set of arcuately formed finger members are positioned in an interlacing and overlapping relation each to the other; said arcuately formed finger members of each said first and second set remaining separated one from the other by open gaps to define a raking structure for directly contacting and selectively collecting the waste material;

a pair of actuating members coupled to said finger members for reversibly displacing said first and second sets of said finger members from said second position to said first position;

a hinge mechanism, said hinge mechanism joining said first and second sets of arcuately formed finger members; and, a bag member, said bag member having a closed end section and an opened end section, said bag member fixedly attached at said closed end section to said claw mechanism at said hinge mechanism, said pair of actuating members being located external said bag member and said arcuately formed finger members being located internal to said bag member.

2. The refuse removal system as claimed in claim 1, wherein said first and second set of arcuately formed finger members extend arcuately downwardly from said hinge mechanism.

3. The refuse removal system as claimed in claim 1, wherein said first and second set of arcuately formed finger members have respective inner and outer surfaces wherein said inner surfaces are convexly contoured and said outer surfaces are concavely contoured.

4. The refuse removal system as claimed in claim 1, wherein each of said actuating members are formed in one-piece formation with a respective one of arcuately formed finger members.

5. The refuse removal system as claimed in claim 1, wherein said hinge mechanism includes a biasing mechanism for maintaining said first and second sets of arcuately formed finger members in said first or second position.

6. The refuse removal system as claimed in claim 5, wherein said biasing mechanism includes:

a central bearing shaft;

a spring portion wound about said central bearing shaft, said spring portion having opposing end sections bearing against respective actuating members.

7. The refuse removal system as claimed in claim 1, wherein said actuating members are displaceably moveable for displacing said first and second set of arcuately formed finger members from said second position to said first position.

8. The refuse removal system as claimed in claim 1, wherein said bag member is formed of a flexible material, said flexible material being impervious to the passage of said waste material.

9. The refuse removal system as claimed in claim 8 wherein said bag member is formed of a plastic composition.

10. The refuse removal system as claimed in claim 9 wherein said bag member is formed of a closed cell plastic composition.

11. The refuse removal system as claimed in claim 1, wherein said bag member is sealed to said actuating members and said finger members in a manner wherein said finger members extend external said bag and said actuating members are located internal said bag prior to removal of said waste material.

12. The refuse removal system as claimed in claim 11, wherein said bag member is sealed to said hinge mechanism.

13. The refuse removal system as claimed in claim 1, wherein said bag member includes a string member secured to said bag member at an upper end, wherein said string member ties said bag member subsequent said waste material being contained therein.

14. The refuse removal system as claimed in claim 1, wherein said first and second sets of arcuately formed fingers maintain in one of said first and second positions an open cage structure for loosely cradled capture of the waste material therein.

15. A method for removing waste material, the method comprising the steps of:

providing a bag member having an internal volume defining an inner surface and an outer surface;

providing a waste disposal claw mechanism extending through a bottom wall of said bag member and secured thereto, said waste disposal mechanism including first and second sets of arcuately formed finger members, said arcuately formed finger members of each said first and second set remaining separated one from the other by open gaps to define a raking structure for directly contacting and selectively collecting the waste material;

inverting said bag member over a forearm of a user;

actuating said waste disposal claw mechanism to a first open position;

at least partially encompassing said waste material within said waste disposal claw mechanism;

displacing said waste disposal claw mechanism to a second closed position; and, re-inverting said bag member over said waste disposal claw mechanism thereby capturing said waste material within said internal volume of said bag member.

16. The method of claim 15, further comprising the step of gripping a pair of actuating members attached to said waste disposal claw mechanism.

17. The method of claim 16, further comprising the step of displacing said actuating members to open said first set and a second set of arcuately formed finger members of said waste disposal claw mechanism.

18. The method of claim 17, wherein the step of displacing said waste disposal claw mechanism includes the step of picking up said waste material by releasing a grip on said actuating members thereby encompassing said waste material within said first and second sets of arcuately formed finger members.

19. The method of claim 15, further comprising the step of tying a string member attached to an open end of said bag member subsequent the step of re-inverting said bag member thereby sealing closed said bag member with said waste material contained therein.

20. The method of claim 15, further comprising the step of disposing said bag member with said waste disposal claw mechanism and waste therein.

21. A method for removing refuse without contaminating the hands of a user, said method comprising:

(a) providing a disposable refuse removal system comprising:

(i) a claw mechanism having a first member and a second member, at least one of said first and second member being formed of arcuately formed finger members, said first and second members being pivotally mounted each to the other and longitudinally displaceable each from the other, said first and second members being displaceable from a first position to a second position, said arcuately formed finger members remaining separated one from the other by open gaps to define a raking structure for directly contacting and selectively collecting the refuse;

(ii) a pair of actuating members coupled to said first and second members for displacing said first and second members from said second position to said first position;

(iii) a hinge member, said hinge member joining said first and second members; and, (iv) a bag member, said bag member having a closed end section and an open end section, said bag member fixedly attached at said closed end section to said claw mechanism at said hinge member, wherein said pair of actuating members being located external said bag member and said first and second members being located internal to said bag member;

(b) inverting said bag member over a forearm of said user;

(c) actuating said claw mechanism to said first position;

(d) at least partially encompassing the refuse within said claw mechanism;

(e) displacing said claw mechanism to said second position;

(f) re-inverting said bag member over said claw mechanism thereby capturing the refuse within said internal volume of said bag member.

22. The method of claim 21, further comprising the step of tying a string member attached to an open end of said bag member subsequent the step of re-inverting said bag member thereby sealing closed said bag member with the refuse contained therein.

* * * * *